US011141778B2

(12) United States Patent
Kawano

(10) Patent No.: US 11,141,778 B2
(45) Date of Patent: Oct. 12, 2021

(54) STEEL FOR MOLDS AND MOLDING TOOL

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 395 days.

(21) Appl. No.: 15/750,770

(22) PCT Filed: Sep. 5, 2016

(86) PCT No.: PCT/JP2016/076017
§ 371 (c)(1),
(2) Date: Feb. 6, 2018

(87) PCT Pub. No.: WO2017/043446
PCT Pub. Date: Mar. 16, 2017

(65) Prior Publication Data

US 2018/0229294 A1 Aug. 16, 2018

(30) Foreign Application Priority Data

Sep. 11, 2015 (JP) ..... 2015-180193
Jul. 27, 2016 (JP) ..... JP2016-147774

(51) Int. Cl.
*B22C 9/06* (2006.01)
*C21D 6/00* (2006.01)
(Continued)

(52) U.S. Cl.
CPC ..... *B22C 9/061* (2013.01); *C21D 1/22* (2013.01); *C21D 6/00* (2013.01); *C21D 6/002* (2013.01);
(Continued)

(58) Field of Classification Search
CPC ..... B22C 9/061
See application file for complete search history.

(56) References Cited

U.S. PATENT DOCUMENTS 8,557,056 B2 10/2013 Angles
9,689,061 B2 6/2017 Angles
(Continued)

FOREIGN PATENT DOCUMENTS

CN 103282530 A 9/2013
CN 103774047 A 5/2014
(Continued)

OTHER PUBLICATIONS

Extended European Search Report dated Feb. 7, 2019 for European Patent Application No. 16844307.5-1103.
(Continued)

*Primary Examiner* — James Sanders
(74) *Attorney, Agent, or Firm* — McGinn I.P. Law Group, PLLC.

(57) ABSTRACT

The mold steel according to the present invention contains 0.35<C<0.55 mass %, 0.003≤Si<0.300 mass %, 0.30<Mn<1.50 mass %, 2.00≤Cr<3.50 mass %, 0.003≤Cu<1.200 mass %, 0.003≤Ni<1.380 mass %, 0.50<Mo<3.29 mass %, 0.55<V<1.13 mass %, and 0.0002≤N<0.1200 mass %, with a balance being Fe and unavoidable impurities, and satisfies 0.55<Cu+Ni+Mo<3.29 mass %, and the molding tool according to the present invention contains a mold and/or a mold component formed of the mold steel.

18 Claims, 2 Drawing Sheets

(51) Int. Cl.

| | |
|---|---|
| ***C22C 38/60*** | (2006.01) |
| ***C21D 1/22*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| *C21D 1/18* | (2006.01) |

(52) U.S. Cl.

CPC ..... *C21D 6/004* (2013.01); *C21D 6/005* (2013.01); *C21D 6/008* (2013.01); *C22C 38/00* (2013.01); *C22C 38/001* (2013.01); *C22C 38/02* (2013.01); *C22C 38/04* (2013.01); *C22C 38/42* (2013.01); *C22C 38/44* (2013.01); *C22C 38/46* (2013.01); *C22C 38/60* (2013.01); *C21D 1/18* (2013.01); *C21D 2211/001* (2013.01); *C21D 2211/004* (2013.01); *C21D 2211/008* (2013.01)

(56) References Cited

U.S. PATENT DOCUMENTS

| | | | |
|---|---|---|---|
| 2008/0159901 | A1 | 7/2008 | Beguinot et al. |
| 2010/0189592 | A1 | 7/2010 | Angles |
| 2010/0221139 | A1 | 9/2010 | Beguinot et al. |
| 2014/0023551 | A1 | 1/2014 | Angles |
| 2015/0314366 | A1 | 11/2015 | Kawano |
| 2017/0268084 | A1 | 9/2017 | Angles |

FOREIGN PATENT DOCUMENTS

| | | | |
|---|---|---|---|
| CN | 103993223 | A | 8/2014 |
| CN | 101921958 | B | 2/2015 |
| CN | 104894479 | A | 9/2015 |
| CN | 105018851 | A | 11/2015 |
| EP | 2 218 802 | A1 | 8/2010 |
| EP | 2 270 245 | A1 | 1/2011 |
| EP | 2 660 348 | A1 | 11/2013 |
| EP | 2 722 406 | A1 | 4/2014 |
| EP | 2 915 895 | A2 | 9/2015 |
| EP | 2 939 763 | A2 | 11/2015 |
| JP | S63-083249 | A | 4/1988 |
| JP | 2000-144334 | A | 5/2000 |
| JP | 2007-308784 | A | 11/2007 |
| JP | 2008-056982 | A | 3/2008 |
| JP | 2008-121032 | A | 5/2008 |
| JP | 2008-169411 | A | 7/2008 |
| JP | 2009-242819 | A | 10/2009 |
| JP | 2009-242820 | A | 10/2009 |
| JP | 2010-500471 | A | 1/2010 |
| JP | 2011-094168 | A | 5/2011 |
| JP | 2013-213255 | A | 10/2013 |
| JP | 2015-209588 | A | 11/2015 |
| JP | 2016-132797 | A | 7/2016 |
| TW | I371497 | B | 9/2012 |
| WO | WO 2004/050933 | A1 | 6/2004 |
| WO | WO 2012/090562 | A1 | 7/2012 |

OTHER PUBLICATIONS

Chinese Office Action, dated Feb. 28, 2019, in Chinese Patent Application No. 201680051762.1.

Chinese Office Action, dated Aug. 21, 2019, in Chinese Application No. 201680051762.1 and English Translation thereof.

European Office Action, dated Sep. 24, 2019, in European Application No. 16844307.5-1103.

International Search Report (ISR) (PCT Form PCT/ISA/210), in PCT/JP2016/076017, dated Oct. 4, 2016.

Korean Notice of Preliminary Rejection dated Jun. 4, 2019 for Korean Patent Application No. 10-2018-7006436, and English translation thereof.

Taiwanese Office Action, dated Jul. 9, 2019, in Taiwanese Application No. 105129462 and English Translation thereof.

Notification of the Decision of Rejection dated Dec. 3, 2019 for Chinese Patent Application No. 201680051762.1 and English translation thereof.

Notification of Reasons for Refusal, dated Jun. 16, 2020, in Japanese Application No. 2016-147774 and English Translation thereof.

Japanese Office Action, dated Nov. 24, 2020, in Japanese Application No. 2016-147774 and English Translation thereof.

[FIG. 1]
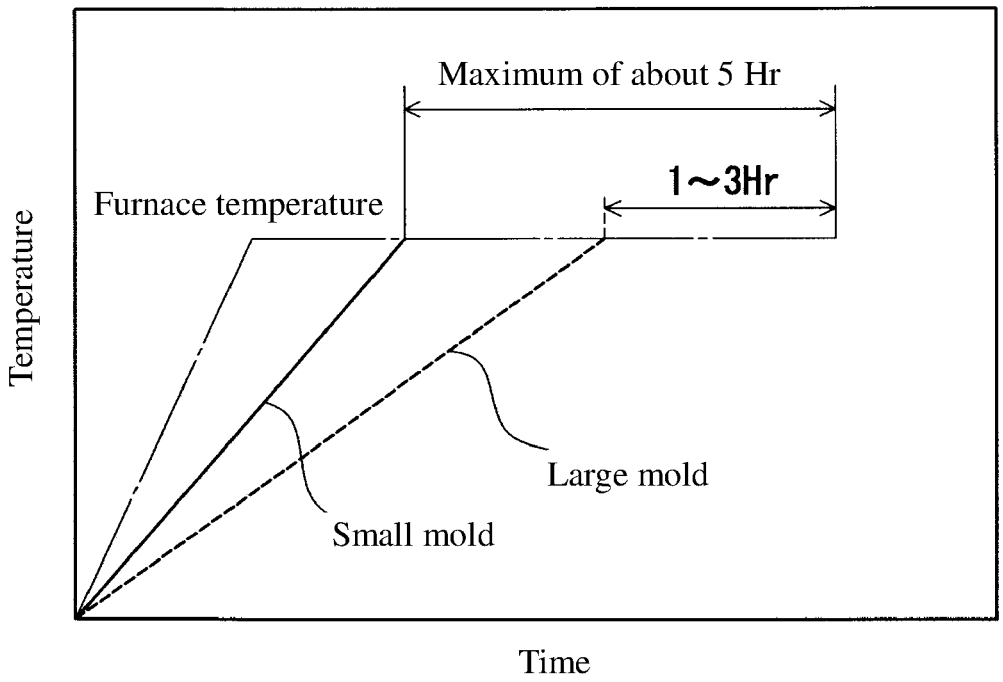
[FIG. 2]
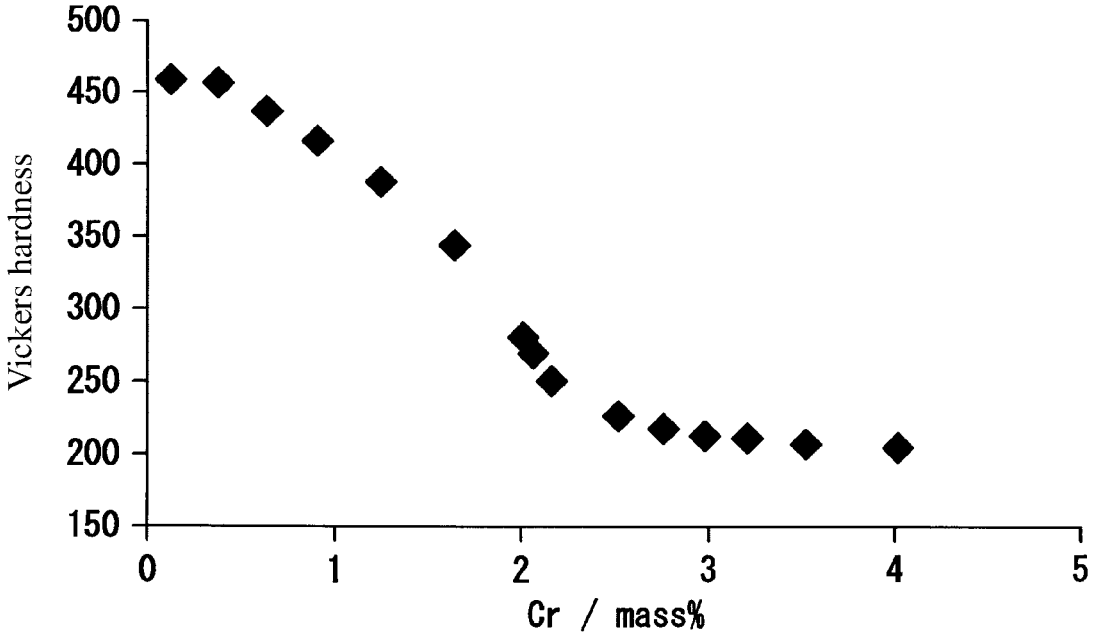

[FIG. 3]
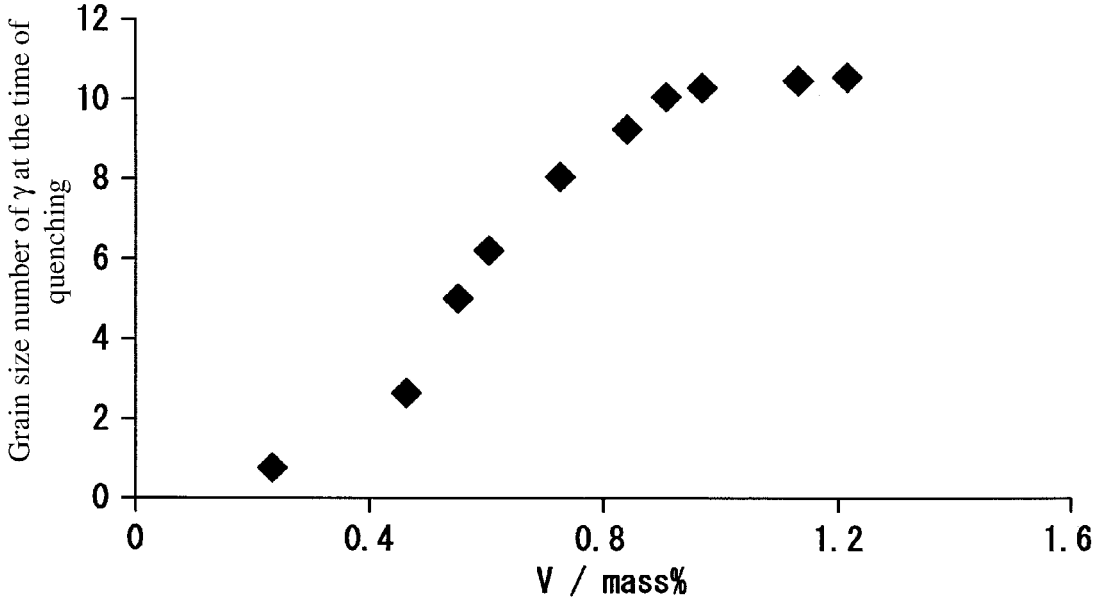
[FIG. 4]
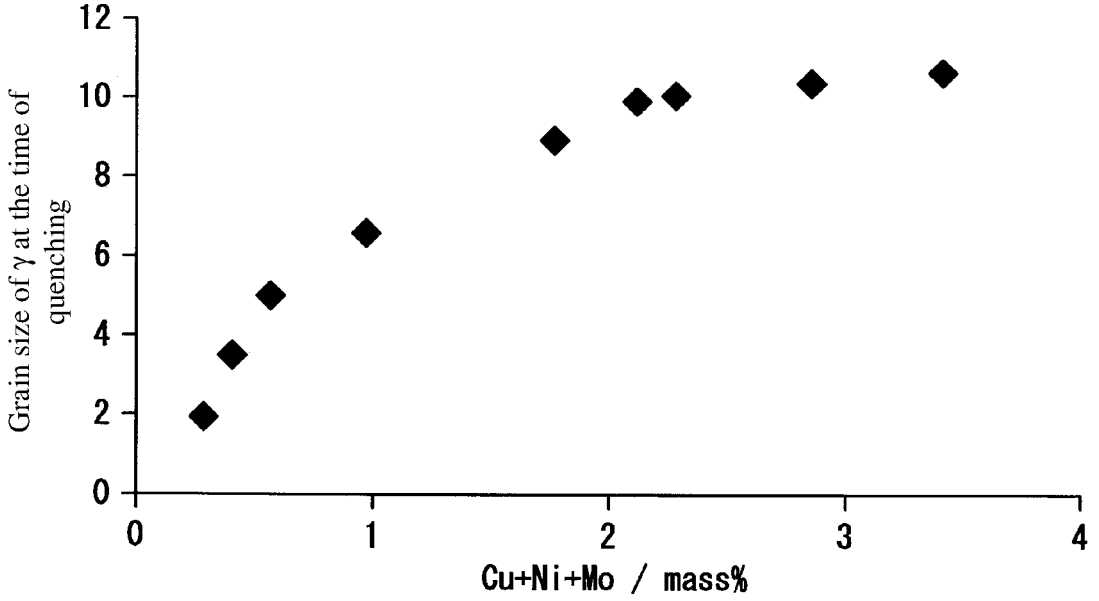

STEEL FOR MOLDS AND MOLDING TOOL

TECHNICAL FIELD

The present invention relates to a mold steel and a molding tool using the same. The molding tool is constructed of a mold or a mold component alone, or of a combination thereof. The molding tool is used for die casting, plastic injection molding, rubber processing, various kinds of casting, warm forging, hot forging, hot stamping, or the like. The molding tool therefor has a portion that comes into contact with a workpiece having a higher temperature than room temperature.

BACKGROUND ART

A mold which is used for die casting, injection molding, hot or warm plastic working, or the like is manufactured typically by performing a quenching and tempering on a material and processing it into a predetermined shape by diesinking or the like. In addition, when a hot or warm processing is performed by using such a mold, the mold is exposed to a large heat cycle and a high load. Therefore, the material used for this kind of mold is required to be excellent in toughness, high-temperature strength, wear resistance, crack resistance, heat check resistance, and the like. However, in general, it is difficult to improve a plurality of properties of mold steel at the same time.

Therefore, in order to solve this problem, various proposals have been made heretofore.

For example, Patent Document 1 discloses a mold steel containing, by mass %, C: 0.1 to 0.6, Si: 0.01 to 0.8, Mn: 0.1 to 2.5, Cu: 0.01 to 2.0, Ni: 0.01 to 2.0, Cr: 0.1 to 2.0, Mo: 0.01 to 2.0, one kind or two or more kinds of V, W, Nb, and Ta: 0.01 to 2.0 in total, Al: 0.002 to 0.04, N: 0.002 to 0.04, O: 0.005 or lower, with the balance being Fe and unavoidable impurities.

This Document describes that, by performing a heat treatment on such a material under predetermined conditions, thermal fatigue resistance and softening resistance are improved, and thus heat check and water cooling hole cracking can be suppressed.

Patent Document 2 discloses a mold steel containing, by mass %, C: 0.2 to 0.6%, Si: 0.01 to 1.5%, Mn: 0.1 to 2.0%, Cu: 0.01 to 2.0%, Ni: 0.01 to 2.0%, Cr: 0.1 to 8.0%, Mo: 0.01 to 5.0%, one kind or two or more kinds of V, W, Nb, and Ta: 0.01 to 2.0% in total, Al: 0.002 to 0.04%, N: 0.002 to 0.04%, with the balance being Fe and unavoidable impurities.

This Document describes that such a material is excellent in hardenability and that, by performing a heat treatment on the material under predetermined conditions, a required impact value can be obtained, the life of a mold can be prolonged, and cutting processing can be easily performed.

Patent Document 3 discloses a mold steel containing C: 0.15 to 0.55 mass %, Si: 0.01 to 2.0 mass %, Mn: 0.01 to 2.5 mass %, Cu: 0.01 to 2.0 mass %, Ni: 0.01 to 2.0 mass %, Cr: 0.01 to 2.5 mass %, Mo: 0.01 to 3.0 mass %, at least one kind selected from the group consisting of V and W: 0.01 to 1.0 mass % in total, with the balance being Fe and unavoidable impurities.

This Document describes that, by performing a heat treatment on such a material under predetermined conditions, softening resistance is improved and wear resistance is also improved.

Patent Document 4 discloses a tool steel containing C: 0.26 to 0.55 wt %, Cr: lower than 2 wt %, Mo: 0 to 10 wt %, W: 0 to 15 wt % (where the total content of W and Mo is 1.8 to 15 wt %), (Ti, Zr, Hf, Nb, Ta): 0 to 3 wt %, V: 0 to 4 wt %, Co: 0 to 6 wt %, Si: 0 to 1.6 wt %, Mn: 0 to 2 wt %, Ni: 0 to 2.99 wt %, S: 0 to 1 wt %, with the balance being iron and unavoidable impurities.

This Document describes that, by satisfying such a composition, thermal conductivity becomes higher than that in a conventional tool steel.

Furthermore, Patent Document 5 discloses a mold steel containing, by mass %, $0.35<C\leq0.50$, $0.01\leq Si<0.19$, $1.50<Mn<1.78$, $2.00<Cr<3.05$, $0.51<Mo<1.25$, $0.30<V<0.80$, $0.004\leq N\leq0.040$, with the balance being Fe and unavoidable impurities.

This Document describes that, by satisfying such a composition, thermal conductivity of a mold can be improved.

A molding tool that is constructed of a mold or a mold component alone or of a combination thereof has a portion that comes into contact with a workpiece having a higher temperature than room temperature. Therefore, the molding tool is exposed to a heat cycle of an increase and decrease in temperature during use. Depending on the use purpose, a high pressure may be applied thereto. In order to withstand this severe heat cycle, a mold or a mold component is used in a quenched and tempered state. Heating conditions during quenching vary depending on the composition of the steel, the use, the size of the mold, and the like. However, in many cases, it is held at 1030° C. for about 1 to 3 Hr.

On the other hand, in the industry, "simultaneous loading" of simultaneously heating a large mold and a small mold during quenching is generally performed. However, if heating conditions of quenching are set for a large mold when performing simultaneous loading, a small mold is excessively heated and crystal grains are coarsened.

In addition, recently, in order to reduce the cycle time of die casting, to reduce baking and to reduce heat check, high thermal conductivity steel (thermal conductivity $\lambda$: 24 to 27 [W/m/K]) having excellent cooling efficiency has been increasingly used for a die casting mold. In order to increase the thermal conductivity, the high thermal conductivity steel has a significantly lower Cr content than the Cr content (about 5%) in a general hot die steel.

On the other hand, the low-Cr steel has a low content of carbide remaining during quenching. Therefore, in order to prevent crystal grains from coarsening during quenching, it is necessary to decrease the quenching temperature. However, when a plurality of molds are simultaneously manufactured, in the case where the quenching temperature of one mold is different from the quenching temperature of another mold, there is a problem in that simultaneous loading cannot be performed.

In addition, in the case where the Cr content is low, particularly, further in the case where the content of Mn or Mo is high, it is difficult to perform annealing. That is, a long-term heat treatment is required to soften the steel to a hardness at which machining can be performed, which leads to an increase in costs.

Furthermore, a steel having a thermal conductivity $\lambda$ of higher than 42 [W/m/K] which is obtained by limiting the Cr to be 0.5 mass % or lower has been also known. However, since such a steel has a low high-temperature strength and a low corrosion resistance, it is not recommended for use in a mold component exposed to a temperature cycle.

That is, for mold steel exposed to a temperature cycle, it is required to satisfy:

(a) capable of securing required high-temperature strength and corrosion resistance;

(b) capable of reducing costs of the material (i.e., annealing properties are excellent, and a heat treatment for softening can be easily performed);

(c) capable of improving productivity (i.e., simultaneous loading) of quenching;

(d) having a high thermal conductivity to an extent that cycle time can be reduced or baking or heat check of a mold can be reduced; and (e) capable of, during quenching, maintaining austenite crystal grains fine to an extent that cracking of a mold can be prevented (coarsening of crystal grains can be prevented).

However, in the related art, there is no example that proposes a steel satisfying the above-described requirements at the same time.

PRIOR ART DOCUMENT

Patent Document

Patent Document 1: JP-A-2008-056982
Patent Document 2: JP-A-2008-121032
Patent Document 3: JP-A-2008-169411
Patent Document 4: JP-T-2010-500471
Patent Document 5: JP-A-2011-094168

SUMMARY OF THE INVENTION

Problems that the Invention is to Solve

An object to be achieved by the present invention is to provide: a mold steel that is excellent in high-temperature strength and corrosion resistance, has good annealing properties, high productivity of quenching and high thermal conductivity, and can generate fine austenite crystal grains during quenching; and a molding tool that is constructed of a mold or a mold component formed of the same.

Means for Solving the Problems

In order to achieve the above-mentioned object, a molding tool according to the present invention has the gist of including the following configurations.

(1) The molding tool contains a mold or a mold component alone or a combination thereof and includes a portion that comes into direct contact with a workpiece having a temperature higher than room temperature.

(2) At least one of the mold or the mold component is formed of a mold steel containing:

$0.35<C<0.55$ mass %,
$0.003\leq Si<0.300$ mass %,
$0.30<Mn<1.50$ mass %,
$2.00\leq Cr<3.50$ mass %,
$0.003\leq Cu<1.200$ mass %,
$0.003\leq Ni<1.380$ mass %,
$0.50<Mo<3.29$ mass %,
$0.55<V<1.13$ mass %, and
$0.0002\leq N<0.1200$ mass %,
with a balance being Fe and unavoidable impurities, and
satisfying $0.55<Cu+Ni+Mo<3.29$ mass %, and has:

a hardness being higher than 33 HRC and 57 HRC or lower, a grain size number of prior austenite at the time of quenching being 5 or more, and a thermal conductivity $\lambda$ at 25° C. measured by using a laser flash method being higher than 27.0 [W/m/K].

The mold steel according to the present invention has the gist of containing:

$0.35<C<0.55$ mass %,
$0.003\leq Si<0.300$ mass %,
$0.30<Mn<1.50$ mass %,
$2.00\leq Cr<3.50$ mass %,
$0.003\leq Cu<1.200$ mass %,
$0.003\leq Ni<1.380$ mass %,
$0.50<Mo<3.29$ mass %,
$0.55<V<1.13$ mass %, and
$0.0002\leq N<0.1200$ mass %,
with a balance being Fe and unavoidable impurities, and
satisfying $0.55<Cu+Ni+Mo<3.29$ mass %.

Advantageous Effect of the Invention

In the present invention, (a) the contents of C, Mo and V are adjusted in order to secure a tempering hardness, (b) the contents of Si, Cr and Mn are adjusted in order to secure a high thermal conductivity, and (c) the contents of Cr and Mn are adjusted in order to secure hardenability and annealing properties.

Furthermore, in the present invention, in order to refine prior austenite crystal grains, the pinning effect and the solute drag effect are actively utilized in combination.

That is, (d) the contents of C, V and N relating to VC particles, which suppress the movement of a grain boundary by the pinning effect, are adjusted, and (e) the contents of Cu, Ni and Mo as solid solution elements, which suppress the movement of a grain boundary by the solute drag effect, are adjusted.

As a result, the mold steel according to the present invention is excellent in high-temperature strength and corrosion resistance, has good annealing properties, high productivity of quenching and high thermal conductivity, and can generate fine austenite crystal grains during quenching.

BRIEF DESCRIPTION OF DRAWINGS

FIG. 1 this is a schematic diagram illustrating transitions of a furnace temperature and a mold temperature during heating in simultaneous loading.

FIG. 2 this is a diagram showing a relationship between the Cr content and the Vickers hardness of an annealed material.

FIG. 3 this is a diagram showing a relationship between the V content and a grain size number of $\gamma$ at the time of quenching.

FIG. 4 this is a diagram showing a relationship between the (Cu+Ni+Mo) content and a grain size number of $\gamma$ at the time of quenching.

MODE FOR CARRYING OUT THE INVENTION

Hereinafter, an embodiment of the present invention will be described in detail.

[1. Mold Steel]

The mold steel according to the present invention contains the following elements with the balance being Fe and unavoidable impurities. The kinds of the addition elements, component ranges thereof and reasons for these restrictions are as follows.

[1.1. Main Constituent Elements]

(1) 0.35<C<0.55 Mass %:

In the case where quenching rate is slow and tempering temperature is high, as the C content decreases, it is difficult to stably obtain a hardness of higher than 33 HRC. Accordingly, it is necessary that the C content is higher than 0.35 mass %. The C content is preferably higher than 0.36 mass % and more preferably higher than 0.37 mass %.

On the other hand, in the case where the C content is excessively high, the amount of coarse carbide increases, which serves as a starting point of cracking and leads to deterioration in toughness. In addition, the amount of residual austenite increases, which becomes coarse bainite at the time of tempering and leads to deterioration in toughness. Furthermore, in the case where the C content is excessively high, weldability deteriorates. In addition, the maximum hardness becomes excessively high, and it is difficult to perform machining. Accordingly, it is necessary that the C content is lower than 0.55 mass %. The C content is preferably lower than 0.54 mass %.

(2) 0.003≤Si<0.300 Mass %:

In general, as the Si content decreases, thermal conductivity increases. However, in the case where the Si content decreases more than is necessary, the effect of increasing thermal conductivity tends to be saturated, and it is difficult to further obtain the effect of high thermal conductivity. In addition, in the case where the Si content is excessively low, machinability during machining significantly deteriorates. Furthermore, although it cannot be said that it is impossible to reduce the Si content more than is necessary if a raw material is carefully selected and refining is optimized, an increase in costs is significant. Accordingly, it is necessary that the Si content is 0.003 mass % or higher. The Si content is preferably 0.005 mass % or higher and more preferably 0.007 mass % or higher.

On the other hand, in the case where the Si content is excessively high, a decrease in thermal conductivity is significant. In addition, the mold steel according to the present invention has a relatively high V content. Therefore, V-based carbide is likely to be crystallized during casting, which is necessarily solid-solubilized in a subsequent heat treatment. However, in the case where the Si content is excessively high, the V-based crystallized carbide is likely to grow in size and is difficult to be solid-solubilized. The V-based crystallized carbide which remains without being solid-solubilized is detrimental because it serves as a starting point of cracking during use as a mold. Furthermore, in the case where the Si content is excessively high, a problem that segregation of other elements becomes significant during casting is likely to occur. Accordingly, it is necessary that the Si content is lower than 0.300 mass %. The Si content is preferably lower than 0.230 mass % and more preferably lower than 0.190 mass %.

(3) 0.30<Mn<1.50 Mass %:

In the case where the Mn content is low, hardenability is insufficient and toughness deteriorates due to incorporation of bainite. Accordingly, it is necessary that the Mn content is higher than 0.30 mass %. The Mn content is preferably higher than 0.35 mass % and more preferably higher than 0.40 mass %.

On the other hand, in the case where the Mn content is excessively high, annealing properties significantly deteriorate, and a heat treatment for softening becomes complex and requires a long period of time, which causes an increase in manufacturing costs. The deterioration in annealing properties caused by high Mn content is significant in the case of low-Cr, high-Cu, high-Ni, and high-Mo. In addition, in the case where the Mn content is excessively high, a decrease in thermal conductivity is also large. Accordingly, it is necessary that the Mn content is lower than 1.50 mass %. The Mn content is preferably lower than 1.35 mass % and more preferably lower than 1.25 mass %.

(4) 2.00≤Cr<3.50 Mass %:

In the case where the Cr content is low, hardenability is insufficient, corrosion resistance becomes extremely poor, and annealing properties significantly deteriorate. Accordingly, it is necessary that the Cr content is 2.00 mass % or higher. The Cr content is preferably higher than 2.05 mass %, more preferably higher than 2.15 mass % and still more preferably higher than 3.03 mass %. In the case where the Cr content is higher than 3.03 mass %, even in the case where the amount of elements that have a large solute drag effect but deteriorate annealing properties, such as Cu, Ni and Mo, is large, annealing properties can be secured.

On the other hand, in the case where the Cr content is excessively high, a decrease in thermal conductivity becomes large. Accordingly, it is necessary that the Cr content is lower than 3.50 mass %. The Cr content is preferably lower than 3.45 mass % and more preferably lower than 3.40 mass %.

(5) 0.003≤Cu<1.200 Mass %:

In the case where the Cu content is low, the solute drag effect which suppresses the movement of a γ grain boundary during quenching becomes poor. Accordingly, an effect of suppressing the coarsening of crystal grains (reducing the grain size number) is not obtained. In addition, in the case where the Cu content is low, for example, there arise the following problems: (a) an effect of improving hardenability is poor; (b) it is difficult to exhibit weather resistance of steel containing Cr—Cu—Ni; and (c) an effect of increasing hardness due to age hardening is also poor; and (d) an effect of improving machinability is also low. Furthermore, although it is not impossible to reduce the Cu content more than is necessary if a raw material is carefully selected and a Cu removal technique by refining which has been studied in various fields is applied, an increase in costs is significant. Accordingly, it is necessary that the Cu content is 0.003 mass % or higher. The Cu content is preferably 0.004 mass % or higher and more preferably 0.005 mass % or higher.

On the other hand, in the case where the Cu content is excessively high, there arise the following problems: (a) cracking during hot working is actualized; (b) the thermal conductivity decreases; (c) an increase in costs is significant; (d) an effect of improving machinability and an effect of increasing hardness due to age hardening are substantially saturated; and the like. Accordingly, it is necessary that the Cu content is lower than 1.200 mass %. The Cu content is preferably lower than 1.170 mass %, more preferably lower than 1.150 mass %, and still more preferably 0.7 mass % or lower. In the case where the Cu content is 0.7 mass % or lower, an excessive decrease in annealing properties or thermal conductivity can be avoided while the solute drag effect is highly exhibited.

(6) 0.003≤Ni<1.380 mass %:

Ni can be added in order to maintain fine crystal grains during quenching because it has a high solute drag effect like in Cu. On the other hand, Cu deteriorates hot workability in some cases, whereas Ni not only does not deteriorate hot workability and but also has an effect of recovering deterioration in hot workability caused by Cu addition.

However, in the case where the Ni content is low, there arise the following problems: (a) the solute drag effect is poor, (b) an effect of improving hardenability is low; (c) it is difficult to exhibit weather resistance of steel containing Cr—Cu—Ni; and the like. In addition, in the case where Al is present, Ni has an effect of increasing the strength by being bonded to Al to form an intermetallic compound. However, in the case where the Ni content is low, this effect is poor. Furthermore, although it is not impossible to reduce Ni more than is necessary if a raw material is carefully selected, an increase in costs is significant. Accordingly, it is necessary that the Ni content is 0.003 mass % or higher. The Ni content is preferably 0.004 mass % or higher and more preferably 0.005 mass % or higher.

On the other hand, in the case where the Ni content is excessively high, there arise the following problems: (a) the effect of recovering deterioration in hot workability caused by Cu addition is saturated; (b) a decrease in thermal conductivity is significant; (c) deterioration in toughness caused by precipitation of an intermetallic compound bonded to Al is significant; (d) homogenization of properties is difficult due to severe segregation; and the like. Accordingly, it is necessary that the Ni content is lower than 1.380 mass %. The Ni content is preferably lower than 1.250 mass %, more preferably lower than 1.150 mass %, and still more preferably 0.7 mass % or lower. In the case where the Ni content is 0.7 mass % or lower, an excessive decrease in annealing properties or thermal conductivity can be avoided while the solute drag effect is highly exhibited.

In the case where a certain amount or more of Cu is contained and hot workability is significantly poor, it is preferable that the Ni content is 0.3 to 1.2 times the Cu content.

On the other hand, even in the case of containing Cu, in the case where cracking can be reduced by optimizing a processing temperature, a processing method or the like, it is not necessary that the Ni content is set to 0.3 to 1.2 times the Cu content.

(7) 0.50<Mo<3.29 Mass %:

Mo can be added in order to maintain fine crystal grains during quenching because it has a relatively high solute drag effect like in Cu or Ni. Mo also has an advantageous effect in that it does not deteriorate hot workability unlike Cu. In the case where the Mo content is low, there arise the following problems: (a) the solute drag effect is low; (b) contribution of secondary hardening is small, and in the case where the tempering temperature is high, it is difficult to stably obtain a hardness of higher than 33 HRC; (c) an effect of improving corrosion resistance by combined addition with Cr is low; and the like. Accordingly, it is necessary that the Mo content is higher than 0.50 mass %. The Mo content is preferably higher than 0.53 mass % and more preferably higher than 0.56 mass %.

On the other hand, in the case where the Mo content is excessively high, there arise the following problems: (a) fracture toughness deteriorates; (b) an increase in material costs is significant; and the like. Accordingly, it is necessary that the Mo content is lower than 3.29 mass %. The Mo content is preferably lower than 3.27 mass % and more preferably lower than 3.25 mass %.

(8) 0.55<V<1.13 Mass %:

In order to maintain fine crystal grains during quenching, it is necessary that the solute drag effect of solid solution elements and the pinning effect of dispersed particles are utilized in combination. In order to adjust VC of dispersed particles to be an appropriate amount, it is preferable that the V content is adjusted in consideration of the C content. In the case where the V content is low, the VC content becomes low and thus, an effect of suppressing the coarsening of γ crystal grain (reducing the grain size number) is poor. Accordingly, it is necessary that the V content is higher than 0.55 mass %. The V content is preferably higher than 0.56 mass % and more preferably higher than 0.57 mass %.

On the other hand, in the case where V is added more than is necessary, the effect of maintaining fine crystal grains is saturated. In addition, in the case where the V content is excessively high, the amount of coarse crystallized carbide (which precipitates during solidification) increases, which serves as a starting point of cracking and leads to deterioration in toughness. Furthermore, as the V content increases, the costs also increase significantly. Accordingly, it is necessary that the V content is lower than 1.13 mass %. The V content is preferably lower than 1.11 mass % and more preferably lower than 1.09 mass %.

The present invention is characterized in that the V content and the (Cu+Ni+Mo) content are set within non-conventional ranges in addition to containing the other elements in the predetermined ranges such that the solute drag effect of solid solution elements and the pinning effect of dispersed particles are actively utilized in combination.

(9) 0.0002≤N<0.1200 Mass %:

N also affects the amount of dispersed particles VC. In the case where the N content increases, the solid solution temperature of VC increases. Therefore, even in the case where the C content and the V content are the same, the amount of residual VC during quenching increases.

In the case where the N content is low, the amount of VC particles during quenching is excessively small. Therefore, an effect of suppressing the coarsening of γ crystal grain (reducing the grain size number) is poor. In addition, in the case where Al is present, N has an effect of preventing the coarsening of crystal grains by forming MN particles in an auxiliary manner. However, in the case where the N content is low, such an effect is low. Accordingly, it is necessary that the N content is 0.0002 mass % or higher. The N content is preferably higher than 0.0010 mass % and more preferably higher than 0.0030 mass %.

On the other hand, in the case where the N content is excessively high, the refining time and costs required for N addition increase, which leads to an increase in material costs. Furthermore, in the case where the N content is excessively high, the amount of coarse nitride, carbonitride or carbide increases, which serves as a starting point of cracking and leads to deterioration in toughness. Accordingly, it is necessary that the N content is lower than 0.1200 mass %. The N content is preferably lower than 0.1000 mass % and more preferably lower than 0.0800 mass %.

(10) Unavoidable Impurities:

The mold steel according to the present invention may include, as unavoidable impurities:

P≤0.05 mass %,
S≤0.003 mass %,
Al≤0.10 mass %,
W≤0.30 mass %,
O≤0.01 mass %,
Co≤0.10 mass %,
Nb≤0.004 mass %,
Ta≤0.004 mass %,
Ti≤0.004 mass %,
Zr≤0.004 mass %,
B≤0.0001 mass %,
Ca≤0.0005 mass %,
Se≤0.03 mass %,
Te≤0.005 mass %,
Bi≤0.01 mass %,
Pb≤0.03 mass %,
Mg≤0.02 mass %, or
REM≤0.10 mass %.

The mold steel according to the present invention may include one or two or more elements of the above-described elements. In the case where the content of the element is the above-described upper limit or lower, the element acts as an unavoidable impurity.

On the other hand, some of the elements may be contained over the above-described upper limit. In this case, effects described below are obtained depending on the kind and the content of the element.

[1.2. Component Balance]

The mold steel according to the present invention is characterized in that the total content of Cu, Ni and Mo satisfies a relationship of the following Expression (a) in addition to containing the above-described elements:

$$0.55<Cu+Ni+Mo<3.29 \text{ mass } \% \quad (a)$$

As an index for the solute drag effect, the Cu+Ni+Mo content is important. In the case where the total content of these elements is low, sufficient solute drag effect cannot be obtained. Accordingly, it is necessary that the total content of these elements is higher than 0.55 mass %. The total content is preferably higher than 0.60 mass % and more preferably higher than 0.70 mass %.

On the other hand, excessively high total content of these elements causes an actualization of cracking during hot working, a decrease in thermal conductivity, deterioration in toughness caused by precipitation of an excess amount of an intermetallic compound, deterioration in fracture toughness or the like. Accordingly, it is necessary that the total content of these elements is lower than 3.29 mass %. The total content is preferably lower than 3.28 mass % and more preferably lower than 3.27 mass %.

[1.3. Auxiliary Constituent Elements]

The mold steel according to the present invention may further contain one or two or more elements described below in addition to the above-described main constituent elements. The kinds of the addition elements, component ranges thereof and reasons for these restrictions are as follows.

(1) $0.30<W\leq5.00$ mass %:

(2) $0.10<Co\leq4.00$ mass %:

The present invention has a not-so-high hardenability because the total content of Mn and Cr is low as compared to SKD61 or the like which is general-purpose steel for a die casting mold. Therefore, in the case where the quenching rate is slow and tempering is performed at a high temperature, it is difficult to secure a hardness of higher than 33 HRC. In this case, it is advisable to secure the strength by selectively adding W or Co. W increases the strength by precipitation of carbide. Co increases the strength by solid-solubilizing in matrix and also contributes to precipitation hardening through a change in carbide morphology.

In addition, these elements are solid-solubilized in γ during quenching and exhibit a relatively high solute drag effect. In order to utilize the pinning effect of VC particles and the solute drag effect of solute atoms to stably obtain fine γ crystal grains, it is effective to add W or Co. In order to obtain such an effect, it is preferable that each of the W content and the Co content is higher than the above-described lower limit.

On the other hand, in the case where the contents of these elements are excessively high, the properties are saturated and the costs significantly increase. Accordingly, it is preferable that each of the W content and the Co content is the upper limit or lower.

The mold steel may contain either of W and Co, and may contain both of them.

(3) $0.004<Nb\leq0.100$ mass %:

(4) $0.004<Ta\leq0.100$ mass %:

(5) $0.004<Ti\leq0.100$ mass %:

(6) $0.004<Zr\leq0.100$ mass %:

In the case where the quenching heating temperature increases or the quenching time increases due to unexpected equipment trouble or the like, the coarsening of crystal grains is concerned even in the basic components of the mold steel according to the present invention. For such an occasion, Nb, Ta, Ti, and/or Zr may be selectively added. In the case where these elements are added, these elements form a fine precipitate. The fine precipitate suppresses the movement of a γ grain boundary (pinning effect) and thus can maintain a fine austenite structure. In order to obtain such an effect, it is preferable that each of the contents of these elements is higher than the above-described lower limit.

On the other hand, in the case where the contents of these elements are excessively high, an excess amount of carbide, nitride or oxide generates, which leads to deterioration in toughness. Accordingly, it is preferable that each of the contents of these elements is the above-described upper limit or lower.

The mold steel may contain any one kind of these elements or may contain two or more kinds thereof.

(7) $0.10<Al\leq1.50$ mass %:

Al has an effect (pinning effect) of suppressing the growth of γ crystal grains by being bonded to N to form AlN. In addition, Al has high affinity to N and accelerates the introduction of N into steel. Therefore, when a steel containing Al is subjected to a nitriding treatment, the surface hardness is likely to increase. For a mold on which a nitriding treatment is performed to obtain higher wear resistance, it is effective to use a steel containing Al. In order to obtain such an effect, it is preferable that the Al content is higher than 0.10 mass %.

On the other hand, in the case where the Al content is excessively high, thermal conductivity or toughness deteriorates. Accordingly, it is preferable that the Al content is 1.50 mass % or lower.

Even in the case where the Al content is at the impurity level (0.10 mass % or lower), the above-mentioned effect may be exhibited depending on the N content.

(8) $0.0001<B\leq0.0050$ mass %:

B addition is effective as a measure for improving hardenability. However, in the case where B forms BN, the effect of improving hardenability is not obtained. Therefore, it is necessary that B is present in the steel alone. Specifically, bonding between B and N only has to be suppressed by using an element having higher affinity to N than B to form a nitride. Examples of such an element include Nb, Ta, Ti, and Zr described above. These elements have an effect of fixing N even in the case of existing at the impurity level (0.004 mass % or lower). However, they may be added in a content over the impurity level in some cases depending on the N content. Even in the case where a portion of B is bonded to N in the steel to form BN, if residual B is present in the steel alone, it improves hardenability.

B is also effective to improve machinability. In order to improve machinability, BN may be formed. BN has similar properties to those of graphite, and reduces cutting resistance and at the same time, improves chip-breakability. Furthermore, in the case where B and BN are present in the steel, hardenability and machinability are improved simultaneously.

In order to obtain such an effect, it is preferable that the B content is higher than 0.0001 mass %.

On the other hand, in the case where the B content is excessively high, hardenability deteriorates. Accordingly, it is preferable that the B content is 0.0050 mass % or lower.

(9) 0.003<S≤0.050 mass %:

(10) 0.0005<Ca≤0.2000 mass %:

(11) 0.03<Se≤0.50 mass %:

(12) 0.005<Te≤0.100 mass %:

(13) 0.01<Bi≤0.50 mass %:

(14) 0.03<Pb≤0.50 mass %:

In order to improve machinability, it is also effective to selectively add S, Ca, Se, Te, Bi, or Pb. In order to obtain such an effect, it is preferable that each of the contents of these elements is higher than the above-described lower limit.

On the other hand, in the case where the contents of these elements are excessively high, not only the effect of improving machinability is saturated, but also hot workability deteriorates, and impact value or mirror-surface polishing properties deteriorate. Accordingly, it is preferable that each of the contents of these elements is the above-described upper limit or lower.

The mold steel may contain any one kind of these elements or may contain two or more kinds thereof.

[1.4. Properties]

When the mold steel according to the present invention is subjected to a heat treatment under appropriate conditions, it is achieved:

a hardness being higher than 33 HRC and 57 HRC or lower;

a grain size number of prior austenite at the time of quenching being 5 or more; and a thermal conductivity λ at 25° C. measured by using a laser flash method being higher than 27.0 [W/m/K].

[1.4.1. Hardness]

A mold is required to have properties of hard-to-wear and hard-to-deform. Therefore, hardness is necessary in a mold. In the case where the hardness is higher than 33 HRC, problems of wear and deformation are not likely to occur for use in various applications. The hardness is more preferably 35 HRC or higher.

On the other hand, in the case where the hardness is excessively high, not only finish machining of a mold is extremely difficult to perform, but also large cracking or chipping is likely to occur during use as a mold. Therefore, it is necessary that the hardness is 57 HRC or lower. The hardness is more preferably 56 HRC or lower.

This point is also applicable to a mold component, and it is preferable that the hardness thereof is within the above-described range.

[1.4.2. Grain Size Number of Prior Austenite]

In order to prevent cracking or chipping of a mold, it is preferable that the grain size number of austenite at the time of quenching increases (making austenite crystal grains fine). In the case where the grain size number is small, cleavages are likely to propagate, and cracking or chipping is likely to occur. Accordingly, it is necessary that the grain size number of austenite at the time of quenching is 5 or more. The grain size number of austenite is more preferably 5.5 or more. By optimizing manufacturing conditions, the grain size number is 6 or more or 6.5 or more.

This point is also applicable to a mold component, and it is preferable that the grain size number of prior austenite thereof is within the above-described range.

[1.4.3. Thermal Conductivity]

In order to rapidly cool a product or to reduce mold damages (baking, cracking, or wear) by a decrease in mold temperature or a decrease in thermal stress, it is necessary to increase the thermal conductivity of a mold. The thermal conductivity λ of general-purpose steel, which is used for die casting or the like, at 25° C. is from 23.0 to 24.0 [W/m/K]. Even in steel which is known to have a high thermal conductivity, λ is 27.0 [W/m/K] or lower, which is insufficient. In order to rapidly cool a product or to reduce mold damages, it is necessary that the thermal conductivity λ is higher than 27.0 [W/m/K]. The thermal conductivity λ is more preferably higher than 27.5 [W/m/K]. By optimizing manufacturing conditions, the thermal conductivity is 28.0 [W/m/K] or higher.

This point is also applicable to a mold component, and it is preferable that the thermal conductivity thereof is within the above-described range.

In the present invention, "thermal conductivity" is a value measured at 25° C. by using a laser flash method.

[2. Molding Tool]

The molding tool according to the present invention has the following configurations.

(1) The molding tool is constructed of a mold or a mold component alone or a combination thereof, and has a portion that comes into direct contact with a workpiece having a higher temperature than room temperature.

(2) At least one of the mold or the mold component is formed of the mold steel according to the present invention.

(3) At least one of the mold or the mold component has:

a hardness being higher than 33 HRC and 57 HRC or lower, a grain size number of prior austenite at the time of quenching being 5 or more, and a thermal conductivity λ at 25° C. measured by using a laser flash method being higher than 27.0 [W/m/K].

[2.1. Use]

The molding tool according to the present invention is used for processing a workpiece having a higher temperature than room temperature. Examples of the processing include die casting, plastic injection molding, rubber processing, various kinds of casting, warm forging, hot forging, and hot stamping.

[2.2. Definition]

In the present invention, "molding tool" indicates one that is constructed of the following (a) or (b) alone or a combination thereof and that functions to mold a workpiece into a predetermined shape:

(a) a mold having a portion that comes into direct contact with a workpiece having a higher temperature than room temperature; and (b) a mold component having a portion that comes into direct contact with a workpiece having a higher temperature than room temperature.

In the present invention, the "mold" refers to a part among the molding tool other than the mold component and a component having no portion that comes into direct contact with a workpiece (e.g., a fastener of the mold). For example, in the case of die casting, a mold is provided on each of a movable side and a fixed side. As for the mold, some are generally called as a cavity, a core, or an insert. In the present invention, the insert is considered as a mold component described below.

In the present invention, the "mold component" refers to one that functions to form a workpiece having a higher temperature than room temperature into a predetermined shape by being used alone or in combination with the mold. Accordingly, for example, a bolt or a nut which fastens the mold is not included in the "mold component" described in the present invention. The present invention is characterized by a high thermal conductivity, and one object thereof is to rapidly cool a product obtained by die casting, hot stamping or injection molding. Accordingly, the present invention is applicable to a mold component having a portion that comes into contact with molten metal, a heated steel sheet or molten resin.

For example, in the case of a molding tool for die casting, examples of the mold component include a plunger tip, a sprue bush, a sprue core (sprue spreader), an ejector pin, a chill vent, and an insert.

There are cases where workpiece is molten or semi-molten, and cases of solid. In addition, the temperature of the workpiece varies depending on the use of the molding tool.

For example, in the case of die casting, the temperature of the workpiece (molten metal) in a melting furnace is typically from 580 to 750° C. In the case of plastic injection molding, the temperature of the workpiece (molten plastic) in a kneader is typically, 70 to 400° C. In the case of rubber processing, the temperature of the workpiece (unvulcanized rubber) is typically 50 to 250° C. In the case of warm forging, the heating temperature of the workpiece (steel) is typically 150 to 800° C. In the case of hot forging, the heating temperature of the workpiece (steel) is typically 800 to 1,350° C. In the case of hot stamping, the heating temperature of the workpiece (steel sheet) is typically 800 to 1,050° C.

[2.3. Mold Steel]

In the molding tool according to the present invention, a part or all of the mold and the mold component is formed of the mold steel according to the present invention. Since the details of the composition of the mold steel and properties (hardness, grain size number of prior austenite, thermal conductivity) obtained after an appropriate heat treatment are as described above, the description thereof is omitted.

[3. Action]

[3.1. Required Properties]

Hereinafter, a die casting mold or a component thereof will be described as an example. The die casting mold is used in a quenched and tempered state. In many cases, heating conditions of quenching are quenching temperature of 1,030° C. and holding time at the quenching temperature of from 1 to 3 Hr.

During quenching heating, steel for die casting may be in the austenite single phase in some cases but generally has a mixed structure of austenite and residual carbide. After that, austenite is transformed into a structure including martensite as a main phase by cooling, and hardness and toughness are imparted by a combination with tempering. This is because hardness for securing for erosion resistance and toughness for securing crack resistance are necessary for a mold.

Here, in consideration of the toughness, it is preferable that the grain size number of austenite at the time of quenching is large (the grain size of austenite crystal grains is small). The reason for this is that, as the crystal grains are fine, cracks are difficult to propagate and an effect of suppressing the cracking of the mold is high.

The grain size number of austenite at the time of quenching is determined depending on the heating temperature and the holding time. In the case where the heating temperature is low and the holding time is short, the grain size number of austenite becomes large (crystal grains are fine). Therefore, during quenching, care should be taken such that the heating temperature is not excessively high and the holding time is not excessively long.

In order to prevent the coarsening of crystal grains, a technique of dispersing residual carbide in austenite may be adopted. In this case, steel having a composition in which C content and carbide-forming element content are properly adjusted is used. The residual carbide has the effect (pinning effect) of suppressing the movement of an austenite grain boundary by pinning. As a result, the coarsening of austenite crystal grains is prevented (a large grain size number is maintained).

Here, during quenching, "simultaneous loading" of heating a large mold and a small mold at the same time is generally performed. The reason why simultaneous loading is performed is that, if a mold is processed one by one, the productivity does not increase and the costs are high. FIG. 1 is a schematic diagram illustrating transitions of a furnace temperature and a mold temperature during heating of simultaneous loading.

As described above, the heating time of about from 1 to 3 Hr is necessary at the quenching temperature. In the case of simultaneous loading, the holding time at a furnace temperature is set such that the large mold is under the above-described conditions. In this case, the small mold with a fast temperature increase rate is held for a maximum of about 5 Hr and thus, crystal grains are coarsened (the grain size number is reduced).

Recently, in order to reduce the cycle time of die casting, to reduce baking and to reduce heat check, high thermal conductivity steel having high cooling efficiency has been increasingly used in a die casting mold. SKD61, which is a general-purpose steel for a die casting mold, has a thermal conductivity λ at 25° C. being from 23.0 to 24.0 [W/m/K]. On the other hand, the high thermal conductivity steel has the thermal conductivity λ of from 24.0 to 27.0 [W/m/K]. In order to increase the thermal conductivity, such steel has a significantly lowered Cr content as compared with the Cr content (about 5%) in general hot die steel.

However, such steel contains little or substantially no carbide remaining during quenching at 1,030° C. Therefore, in order to prevent the coarsening of crystal grains during quenching (to adjust the grain size number of austenite to be 5 or more), it is necessary that the quenching temperature is set to lower than 1,020° C. In this case, the quenching temperature is different only for a mold formed of this steel from other molds. Therefore, it is necessary to perform quenching individually. That is, only the single mold formed of the steel is charged into a large furnace to perform a heat treatment thereon, and the productivity is significantly low.

In the case where the Cr content is low, particularly, further in the case where the content of Mn or Mo is high, it is difficult to perform annealing. That is, a long-term heat treatment is required to soften the steel to a hardness at which machining can be performed, which leads to an increase in costs.

In addition, a steel having a thermal conductivity λ of higher than 42.0 [W/m/K] which is obtained by including substantially no Cr (Cr≤0.5%) has been also known. However, since such a steel has a low high-temperature strength and a low corrosion resistance, it is not recommended for use in a die casting mold.

In conclusion, if there is steel that has a corrosion resistance capable of withstanding practical use (2≤Cr<<5%), has excellent annealing properties, has a grain size number of austenite being 5 or more even after being held at 1,030° C. for 5 Hr, has, when quenching and tempering are performed thereafter, a thermal conductivity at 25° C. being higher than 27.0 [W/m/K], and has a high-temperature strength capable of withstanding practical use, the following four points can be realized at the same time:

(1) reduction of the material costs (hardenability is excellent, and a heat treatment for softening is easily performed);

(2) improved productivity in hardenability (in the case of the quenching of a large mold at 1,030° C., simultaneous loading can be performed);

(3) reduction in cycle time of die casting and reduction of baking and heat check of a mold (high thermal conductivity); and (4) prevention of cracking of a die casting mold (fine austenite during quenching).

However, heretofore, such steel is not present. Industrial needs for high thermal conductivity steel capable of suppressing the coarsening during quenching are very high.

[3.2. Optimization of Components]

The steel capable of realizing the above is the present invention. The contents of Cr, Mo and V are adjusted in order to secure a tempering hardness. In addition, the contents of Si, Cr and Mn are adjusted in order to secure a high thermal conductivity. In addition, the contents of Cr and Mn are adjusted in order to secure hardenability and annealing properties.

In addition, in order to make the austenite crystal grains at the time of quenching fine (to increase the grain size number), the contents of C, V and N, which relates to VC particles that suppress the movement of a grain boundary of crystal grains by the pinning effect, are adjusted. In particular, the V content is important.

Furthermore, in order to make the austenite crystal grains at the time of quenching fine, the contents of Cu, Ni and Mo as solid solution elements, which suppress the movement of a crystal grain boundary by the solute drag effect, are adjusted. In particular, the (Cu+Ni+Mo) content is important.

One large characteristic of the present invention is that the pinning effect and the solute drag effect are actively utilized in combination, and the V content and the (Cu+Ni+Mo) content are in a non-conventional balance.

In the case where a large amount of Cu is added, cracking during hot working is likely to actualize. In order to prevent this, Ni addition is effective. However, the Ni addition is limited to a content in which the thermal conductivity of a mold formed thereof does not excessively decrease.

The mold steel according to the present invention has a grain size number of austenite being 5 or more even in the case of quenching of holding at 1,030° C. for 5 Hr. Therefore, the toughness after quenching and tempering is high, and the cracking of the mold can be prevented.

In addition, the mold steel according to the present invention has a thermal conductivity of higher than 27.0 [W/m/K] after quenching and tempering. Therefore, a reduction in the cycle time of die casting and a reduction in baking can be realized.

Furthermore, a hardness of up to 57 HRC can be obtained after quenching and tempering. Therefore, resistance to wear caused by die casting injection is also high. High hardness is preferable because high wear resistance can be obtained even in the case where the steel is applied to a mold for hot stamping.

The mold steel according to the present invention contains Cr and thus has corrosion resistance capable of withstanding practical use. Therefore, rust is not likely to occur during storage as a material or during use as a mold as compared to steel which contains substantially no Cr (Cr≤0.5%).

A steel material to which Cu is intentionally added has been already present, but the purpose of the Cu addition is to increase hardness or to improve machinability. The present invention is definitely different from the conventional Cu-adding steel in that it focuses on the strong solute drag effect of Cu.

EXAMPLES

Examples 1 to 30 and Comparative Examples 1 to 5

[1. Preparation of Samples]

Molten steel having components shown in Table 1 was cast into 50 kg of ingot and was homogenized at 1,240° C., and then, it was finished into a bar having a rectangular cross-section of 60 mm×45 mm by hot forging.

Subsequently, the steel bar was subjected to normalizing of heating to 1,020° C. and then rapidly cooling, and to tempering of heating to 630° C. Furthermore, after heating to 820 to 900° C., the steel bar was subjected to annealing of control-cooling to 600° C. at 15° C./Hr, allowing it to stand to cool to 100° C. or lower, and then heating again to 630° C. A specimen was cut from the steel bar which was softened as described above, and was used for various inspections.

Comparative Example 1 is a general-purpose steel of JIS SKD61 for a die casting mold. Comparative Example 2 is, similarly, a hot die steel and is a commercially available brand steel. Comparative Examples 3 and 4 are JIS SNCM439 and JIS SCM435, respectively. Comparative Example 5 is a brand steel that is commercially available as a high thermal conductivity steel.

TABLE 1

| | Chemical Components (mass %) | | | | | | | | | | |
|---|---|---|---|---|---|---|---|---|---|---|---|
| No. | C | Si | Mn | Cr | Cu | Ni | Mo | V | N | Cu + Ni + Mo | Others |
| Example 01 | 0.46 | 0.07 | 0.81 | 2.96 | 0.09 | 0.09 | 1.13 | 0.96 | 0.021 | 1.310 | |
| Example 02 | 0.43 | 0.07 | 0.80 | 2.97 | 0.12 | 0.11 | 2.02 | 0.88 | 0.019 | 2.250 | |
| Example 03 | 0.40 | 0.08 | 0.78 | 2.99 | 0.03 | 0.07 | 3.06 | 0.80 | 0.018 | 3.160 | |
| Example 04 | 0.41 | 0.05 | 1.48 | 2.16 | 0.06 | 0.02 | 1.08 | 0.60 | 0.020 | 1.160 | |
| Example 05 | 0.54 | 0.14 | 1.34 | 2.02 | 0.35 | 0.41 | 0.89 | 0.58 | 0.007 | 1.650 | 0.05Nb |
| Example 06 | 0.44 | 0.08 | 0.50 | 3.09 | 0.53 | 0.68 | 1.22 | 1.01 | 0.034 | 2.430 | 0.02Ti, 0.004B |
| Example 07 | 0.52 | 0.06 | 0.41 | 3.20 | 0.90 | 0.05 | 1.61 | 0.56 | 0.012 | 2.560 | 0.03Ta, 0.03Zr |
| Example 08 | 0.38 | 0.13 | 0.68 | 2.83 | 1.16 | 0.14 | 1.81 | 0.97 | 0.027 | 3.110 | 0.017S |
| Example 09 | 0.39 | 0.28 | 0.91 | 2.64 | 0.02 | 0.005 | 2.99 | 0.86 | 0.078 | 3.015 | 0.18Bi |
| Example 10 | 0.49 | 0.06 | 1.11 | 2.55 | 1.09 | 0.77 | 0.99 | 0.85 | 0.030 | 2.850 | 0.10Bi, 0.15Pb |
| Example 11 | 0.42 | 0.005 | 1.24 | 2.06 | 0.62 | 0.50 | 0.67 | 0.78 | 0.009 | 1.790 | 2.08Co |
| Example 12 | 0.36 | 0.25 | 1.05 | 2.09 | 0.81 | 0.59 | 1.31 | 1.12 | 0.002 | 2.710 | |
| Example 13 | 0.49 | 0.22 | 1.00 | 2.91 | 0.44 | 0.17 | 2.19 | 0.92 | 0.091 | 2.800 | |
| Example 14 | 0.44 | 0.03 | 1.21 | 2.28 | 0.71 | 0.08 | 2.39 | 0.70 | 0.051 | 3.180 | |
| Example 15 | 0.48 | 0.11 | 1.41 | 2.36 | 0.18 | 0.23 | 0.54 | 0.68 | 0.024 | 0.950 | 4.02W |
| Example 16 | 0.50 | 0.19 | 0.59 | 3.03 | 0.11 | 0.32 | 2.60 | 0.65 | 0.060 | 3.030 | |

TABLE 1-continued

| No. | Chemical Components (mass %) | | | | | | | | | | |
|---|---|---|---|---|---|---|---|---|---|---|---|
| | C | Si | Mn | Cr | Cu | Ni | Mo | V | N | Cu + Ni + Mo | Others |
| Example 17 | 0.38 | 0.10 | 0.32 | 3.39 | 0.005 | 0.10 | 2.80 | 1.06 | 0.0007 | 2.905 | |
| Example 18 | 0.54 | 0.01 | 1.29 | 2.46 | 1.01 | 0.01 | 0.78 | 0.95 | 0.069 | 1.800 | 0.29Al |
| Example 19 | 0.51 | 0.21 | 0.36 | 3.30 | 0.24 | 1.14 | 1.46 | 0.75 | 0.043 | 2.840 | |
| Example 20 | 0.45 | 0.007 | 1.18 | 2.74 | 0.01 | 0.05 | 0.57 | 0.84 | 0.047 | 0.630 | 3.00W, 1.02Co |
| Example 21 | 0.41 | 0.120 | 0.85 | 3.04 | 0.16 | 0.12 | 1.07 | 0.57 | 0.024 | 1.350 | |
| Example 22 | 0.40 | 0.030 | 0.80 | 3.16 | 0.11 | 0.18 | 2.83 | 0.60 | 0.023 | 3.120 | |
| Example 23 | 0.47 | 0.080 | 0.77 | 3.23 | 0.03 | 0.09 | 1.18 | 0.94 | 0.019 | 1.300 | |
| Example 24 | 0.46 | 0.070 | 0.72 | 3.33 | 0.06 | 0.03 | 2.99 | 0.94 | 0.016 | 3.080 | |
| Example 25 | 0.43 | 0.100 | 0.69 | 3.47 | 0.22 | 0.06 | 2.04 | 0.78 | 0.200 | 2.320 | |
| Example 26 | 0.40 | 0.040 | 0.75 | 3.10 | 0.37 | 0.26 | 1.12 | 0.61 | 0.017 | 1.750 | 0.010S |
| Example 27 | 0.41 | 0.110 | 0.86 | 3.40 | 0.07 | 0.21 | 2.85 | 0.60 | 0.019 | 3.130 | 0.14Al |
| Example 28 | 0.47 | 0.090 | 0.78 | 3.25 | 0.09 | 0.08 | 1.07 | 0.95 | 0.015 | 1.240 | 1.01W |
| Example 29 | 0.46 | 0.060 | 0.81 | 3.19 | 0.10 | 0.07 | 2.99 | 0.93 | 0.018 | 3.160 | 0.53Co |
| Example 30 | 0.44 | 0.140 | 0.79 | 3.07 | 0.51 | 0.35 | 2.02 | 0.79 | 0.020 | 2.880 | 0.021Nb |
| Comparative Example 01 | 0.39 | 0.99 | 0.45 | 5.21 | 0.04 | 0.06 | 1.22 | 0.93 | 0.016 | 1.320 | |
| Comparative Example 02 | 0.33 | 0.27 | 1.12 | 5.49 | 0.03 | 0.05 | 2.49 | 0.54 | 0.019 | 2.570 | |
| Comparative Example 03 | 0.39 | 0.27 | 0.75 | 0.78 | 0.12 | 1.80 | 0.24 | <0.01 | 0.005 | 2.160 | |
| Comparative Example 04 | 0.35 | 0.27 | 0.73 | 1.05 | 0.18 | 0.14 | 0.22 | <0.01 | 0.006 | 0.540 | |
| Comparative Example 05 | 0.37 | 0.24 | 0.23 | 0.14 | 0.09 | 0.10 | 4.13 | 0.06 | 0.029 | 4.320 | 3.12W |

[2. Test Method]

[2.1. Annealing Properties]

A small block having a size of 15 mm×15 mm×25 mm which was cut from the annealed bar was used as a specimen. This block was:

(a) simulating hot working, heated to 1,240° C. and held for 0.5 HR, and was cooled to room temperature;

(b) for normalizing, heated to 1,020° C. and held for 2 Hr, and was cooled to room temperature; and (c) for tempering, heated to 670° C. and held for 6 Hr, and was cooled to room temperature.

A series of these heat treatments correspond to steps before annealing in actual production.

The specimen having undergone the above-described pre-treatment was subjected to annealing of heating to 870° C. and holding for 2 Hr, cooling to 580° C. at 15° C./Hr, and thereafter, allowing to stand to cool to room temperature. After annealing, the Vickers hardness was measured.

[2.2. Grain Size of Crystal Grains]

A small block having a size of 15 mm×15 mm×25 mm which was cut from the annealed steel bar was used as a specimen. This block was heated to 1,030° C. and held for 5 Hr, and then, was cooled at a rate of 50° C./min so as to be transformed into martensite. Next, a prior austenite grain boundary before the transformation was caused to appear by using an etchant, and the grain size number thereof was evaluated.

[2.3. Hardness]

After the evaluation of the grain size number, the small block was tired to be thermally refined to have a hardness of 47 HRC, which is a representative hardness for a die casting mold, by heating to and holding at a general tempering temperature of from 580 to 630° C. After tempering, the Rockwell hardness was measured.

[2.4. Thermal Conductivity]

A small disk-shaped specimen having a diameter of 10 mm and a thickness of 2 mm was prepared from the tempered small block. The thermal conductivity λ [W/m/K] of the specimen at 25° C. was measured by using a laser flash method.

[3. Result]

[3.1. Annealing Properties]

[3.1.1. Comparison Between Examples and Comparative Examples]

Table 2 shows the Vickers hardnesses after annealing. In order to easily perform machining, it is preferable that the hardness of an annealed material is lower than 280 HV. Comparative Example 2, which contains large amounts of Mn and Mo, showed 304 HV and Comparative Example 3, which contains a small amount of Cr and large amounts of C, Mn and Ni, showed 321 HV, which are hard. In these steels, difficulty in machining is expected even an annealed material. The other Comparative Examples all showed lower than 280 HV.

On the other hand, Examples 1 to 30 were all softened to from 210 to 276 HV. It was confirmed that Examples 1 to 30 are sufficiently softened through a usual annealing step.

TABLE 2

| No. | Vickers Hardness |
|---|---|
| Example 01 | 212 |
| Example 02 | 224 |
| Example 03 | 246 |
| Example 04 | 276 |
| Example 05 | 243 |
| Example 06 | 210 |
| Example 07 | 257 |
| Example 08 | 234 |
| Example 09 | 231 |
| Example 10 | 269 |
| Example 11 | 240 |
| Example 12 | 229 |
| Example 13 | 265 |
| Example 14 | 276 |
| Example 15 | 230 |
| Example 16 | 261 |
| Example 17 | 221 |
| Example 18 | 241 |
| Example 19 | 256 |
| Example 20 | 268 |
| Example 21 | 220 |
| Example 22 | 224 |
| Example 23 | 221 |
| Example 24 | 228 |
| Example 25 | 226 |
| Example 26 | 231 |
| Example 27 | 225 |

TABLE 2-continued

| No. | Vickers Hardness |
|---|---|
| Example 28 | 225 |
| Example 29 | 240 |
| Example 30 | 223 |
| Comparative Example 01 | 187 |
| Comparative Example 02 | 304 |
| Comparative Example 03 | 321 |
| Comparative Example 04 | 181 |
| Comparative Example 05 | 166 |

[3.1.2. Effect of Cr Content on Annealing Properties]

From the viewpoint of machinability to a mold shape, it is preferable that the hardness of an annealed material is low. Therefore, the above-described annealing was performed on steel containing basic components of 0.40C-0.08Si-1.05Mn-0.18Cu-0.09Ni-1.01Mo-0.62V-0.019N while changing the Cr content. FIG. 2 shows a relationship between the Cr content and the Vickers hardness of the annealed material.

Cases of Cr<2.00 mass % show 280 HV or higher and an increase in hardness is significant (annealing properties are poor). In general, the hardness range of lower than 280 HV is recognized as necessary to efficiently perform machining. Accordingly, in steel with Cr<2.00 mass %, it is necessary to reduce the cooling rate of annealing or to perform additional heating after annealing for softening. As a result, the time of the treatment increases, which leads to an increase in the costs. Cases of Cr>2.15 mass % show 250 HV or lower, and a load of machining is significantly reduced.

[3.2. Grain Size Number]

[3.2.1. Comparison Between Examples and Comparative Examples]

Table 3 shows the grain size numbers. Comparative Example 1, which contains large amounts of C, Cr and V, showed a grain size number of extremely large at about 10. Comparative Example 2 showed a grain size number of sufficiently high at about 7 because amounts of C and V are not so large but amounts of Cr and Mo are large. Comparative Example 3 showed a grain size number of about 2 and was coarse particles because both the V content and the (Cr+Ni+Mo) content are low. Comparative Examples 4 and 5 had poor hardenability and thus, ferrite precipitated. The ferrite content is higher in Comparative Example 5. In the case where ferrite precipitates in an austenite grain boundary, a prior austenite grain boundary is diffused and is difficult to distinguish. Therefore, the size of austenite crystal grains before transformation in Comparative Examples 4 and 5 in which ferrite precipitated are reference values. However, it was determined that the grain size numbers were clearly lower than 5 and were about 2.

On the other hand, the grain size numbers of Examples 1 to 30 were stably more than 5. The reason for this is because the VC content dispersed in matrix during quenching was secured by adjusting C, V and N, and the content of the alloy solid-solubilized in the matrix during quenching was secured by adjusting Cu, Ni and Mo. That is, due to the superposition of the pinning effect and the solute drag effect, a large grain size number is realized.

TABLE 3

| No. | Grain Size Number of Austenite |
|---|---|
| Example 01 | 10.1 |
| Example 02 | 9.9 |
| Example 03 | 9.8 |
| Example 04 | 9.5 |
| Example 05 | 5.6 |
| Example 06 | 10.3 |
| Example 07 | 8.7 |
| Example 08 | 9.2 |
| Example 09 | 8.4 |
| Example 10 | 10 |
| Example 11 | 7.8 |
| Example 12 | 7.3 |
| Example 13 | 10.2 |
| Example 14 | 8.9 |
| Example 15 | 8.2 |
| Example 16 | 9.1 |
| Example 17 | 6.9 |
| Example 18 | 9.6 |
| Example 19 | 9.1 |
| Example 20 | 9.5 |
| Example 21 | 5.3 |
| Example 22 | 5.9 |
| Example 23 | 9.3 |
| Example 24 | 9.9 |
| Example 25 | 9.2 |
| Example 26 | 5.5 |
| Example 27 | 6.1 |
| Example 28 | 9.3 |
| Example 29 | 9.9 |
| Example 30 | 9.0 |
| Comparative Example 01 | 10.1 |
| Comparative Example 02 | 6.8 |
| Comparative Example 03 | 2.1 |
| Comparative Example 04 | 1.8 |
| Comparative Example 05 | 2.2 |

[3.2.2. Effect of V Content on Grain Size Number]

The grain size numbers were investigated in the case of changing the V content in basic components of 0.43C-0.07Si-0.10Cu-0.12Ni-0.81Mn-2.96Cr-1.12Mo-0.021N. FIG. 3 shows a relationship between the V content and the grain size number of γ at the time of quenching. It can be seen from FIG. 3 that a grain size number of 5 or more can be stably obtained in cases of 0.55 mass %<V.

[3.2.3. Effect of (Cu+Ni+Mo) Content on Grain Size Number]

The grain size numbers were investigated in the case of changing the (Cu+Ni+Mo) content in basic components of 0.40C-0.09Si-0.78Mn-2.99Cr-0.61V-0.020N. FIG. 4 shows a relationship between the (Cu+Ni+Mo) content and the grain size number of γ at the time of quenching. It can be seen from FIG. 4 that a grain size number of 5 or more can be stably obtained in cases of 0.55 mass %<Cu+Ni+Mo.

[3.3. Hardness]

Table 4 shows the hardnesses after tempering. Comparative Example 4 showed about 27 HRC and could not secure a hardness of higher than 33 HRC required for a mold, because ferrite precipitated during quenching and the softening resistance was low. Also Comparative Example 5 showed too low hardness (<20 HRC) to be measured by HRC because a large amount of ferrite precipitated during quenching. It can be seen that it is all but impossible to use Comparative Examples 4 and 5 for a mold component for die casting in practice from the viewpoints of hardenability and softening resistance.

Comparative Examples 1 and 2 were able to be thermally refined to be 47 HRC without any problems, as expected of being used for a die casting mold. In addition, all Examples 1 to 30 were able to be thermally refined to be 47 HRC, and it was confirmed that they are applicable to a die casting mold from the viewpoints of hardenability and softening resistance.

TABLE 4

| No. | Tempering HRC |
|---|---|
| Example 01 | 47.0 |
| Example 02 | 47.2 |
| Example 03 | 47.2 |
| Example 04 | 47.1 |
| Example 05 | 47.2 |
| Example 06 | 47.2 |
| Example 07 | 47.1 |
| Example 08 | 46.7 |
| Example 09 | 46.8 |
| Example 10 | 47.3 |
| Example 11 | 46.8 |
| Example 12 | 47.1 |
| Example 13 | 47.2 |
| Example 14 | 47.2 |
| Example 15 | 47.0 |
| Example 16 | 47.3 |
| Example 17 | 46.8 |
| Example 18 | 47.4 |
| Example 19 | 46.9 |
| Example 20 | 46.9 |
| Example 21 | 47.3 |
| Example 22 | 47.4 |
| Example 23 | 46.9 |
| Example 24 | 47.2 |
| Example 25 | 47.1 |
| Example 26 | 47.2 |
| Example 27 | 47.1 |
| Example 28 | 47.1 |
| Example 29 | 47 |
| Example 30 | 47.2 |
| Comparative Example 01 | 47.1 |
| Comparative Example 02 | 47.2 |
| Comparative Example 03 | 33.7 |
| Comparative Example 04 | 27.3 |
| Comparative Example 05 | 18.0 |

[3.4. Thermal Conductivity]

Table 5 shows the thermal conductivity values of the materials shown in Table 4. Comparative Example 1 shows the lowest thermal conductivity because it contains large amounts of Si and Cr. Comparative Example 2 shows a higher thermal conductivity than Comparative Example 1 because it contains not excessively large amount of Si, but remains only $\lambda \leq 27.0$ because it contains a large amount of Cr. Comparative Examples 3 to 5 show high thermal conductivities of $\lambda > 27.0$ because they are low Si and low Cr.

TABLE 5

| No. | Thermal Conductivity [W/m/K] |
|---|---|
| Example 01 | 35.3 |
| Example 02 | 35.2 |
| Example 03 | 35.7 |
| Example 04 | 36.1 |
| Example 05 | 33.5 |
| Example 06 | 32.5 |
| Example 07 | 33.0 |
| Example 08 | 33.5 |
| Example 09 | 33.4 |
| Example 10 | 32.9 |
| Example 11 | 34.7 |
| Example 12 | 32.7 |
| Example 13 | 33.0 |
| Example 14 | 33.7 |
| Example 15 | 33.4 |
| Example 16 | 34.0 |
| Example 17 | 34.8 |
| Example 18 | 33.6 |
| Example 19 | 32.2 |
| Example 20 | 36.0 |
| Example 21 | 33.8 |
| Example 22 | 33.3 |
| Example 23 | 33.5 |

TABLE 5-continued

| No. | Thermal Conductivity [W/m/K] |
|---|---|
| Example 24 | 32.9 |
| Example 25 | 33.0 |
| Example 26 | 33.6 |
| Example 27 | 33.2 |
| Example 28 | 33.2 |
| Example 29 | 32.8 |
| Example 30 | 33.1 |
| Comparative Example 01 | 23.7 |
| Comparative Example 02 | 26.6 |
| Comparative Example 03 | 34.2 |
| Comparative Example 04 | 39.3 |
| Comparative Example 05 | 38.6 |

[3.5 Summary of Evaluation]

Table 6 shows the summary of the above investigation results. The annealing properties, the grain size number of austenite in the case of heating at 1,030° C.×5 Hr, the hardness in the quenched and tempered state, and the thermal conductivity are collectively shown. Comparative Examples 4 and 5 could not achieve a tempering hardness of higher than 33 HRC required for a mold. The other steels were able to be thermally refined to be 47 HRC except for Comparative Example 3. In Table 6, "A" indicates that the object was achieved and means excellent, and "B" indicates that the object was not achieved and means poor.

Comparative Examples 1 to 5 has "B" in any of the items. Comparative Example 1 and Comparative Example 2 are low in the thermal conductivity. Comparative Examples 2 and 3 are poor in the annealing properties. Comparative Examples 3 to 5 have small grain size numbers (crystal grains are coarse). In the case where a die casting mold is formed by using Comparative Example 1 or 2 having a low thermal conductivity, it is difficult to reduce mold damages and to rapidly cool the product.

In the case where a die casting mold is formed by using any of Comparative Examples 3 to 5, large cracking is a concern. In addition, because of the low hardenability, Comparative Examples 4 and 5 is difficult to even apply to a die casting mold.

On the other hand, Examples 1 to 30 show the grain size number of austenite crystal grains at the time of quenching being fine of 5 or more, and have the thermal conductivity being higher than 27 [W/m/K] in the thermally-refined state of 47 HRC. In the case where any of Examples 1 to 20 is actually applied to a die casting mold, it is expected that the following four points can be realized at the same time:

(1) reduction of the material costs (annealing properties are excellent);

(2) improved productivity in hardenability (in the case of the quenching of a large mold at 1,030° C., simultaneous loading can be performed);

(3) reduction in cycle time of die casting and reduction of baking and heat check of a mold (high thermal conductivity); and (4) prevention of cracking of a die casting mold (fine austenite during quenching).

TABLE 6

| No. | Annealing Properties | Grain Size Number | Tempering HRC | Thermal conductivity |
|---|---|---|---|---|
| Example 01 | A | A | A | A |
| Example 02 | A | A | A | A |
| Example 03 | A | A | A | A |

TABLE 6-continued

| No. | Annealing Properties | Grain Size Number | Tempering HRC | Thermal conductivity |
|---|---|---|---|---|
| Example 04 | A | A | A | A |
| Example 05 | A | A | A | A |
| Example 06 | A | A | A | A |
| Example 07 | A | A | A | A |
| Example 08 | A | A | A | A |
| Example 09 | A | A | A | A |
| Example 10 | A | A | A | A |
| Example 11 | A | A | A | A |
| Example 12 | A | A | A | A |
| Example 13 | A | A | A | A |
| Example 14 | A | A | A | A |
| Example 15 | A | A | A | A |
| Example 16 | A | A | A | A |
| Example 17 | A | A | A | A |
| Example 18 | A | A | A | A |
| Example 19 | A | A | A | A |
| Example 20 | A | A | A | A |
| Example 21 | A | A | A | A |
| Example 22 | A | A | A | A |
| Example 23 | A | A | A | A |
| Example 24 | A | A | A | A |
| Example 25 | A | A | A | A |
| Example 26 | A | A | A | A |
| Example 27 | A | A | A | A |
| Example 28 | A | A | A | A |
| Example 29 | A | A | A | A |
| Example 30 | A | A | A | A |
| Comparative Example 01 | A | A | A | B |
| Comparative Example 02 | B | A | A | B |
| Comparative Example 03 | B | B | A | A |
| Comparative Example 04 | A | B | B | A |
| Comparative Example 05 | A | B | B | A |

Hereinabove, the embodiment of the present invention has been described in detail. However, the present invention is not limited to the above-described embodiment, and various modifications can be made within a range not departing from the gist of the present invention.

INDUSTRIAL APPLICABILITY

The mold steel according to the present invention is suitable for a die casting mold or a component thereof, since austenite crystal grains are not likely to be coarsened during quenching and high hardness and high thermal conductivity can be obtained after tempering. In the case where the mold steel according to the present invention is applied to a die casting mold or a component thereof, suppression of cracking or baking of the mold or the component thereof and reduction of cycle time of die casting can be realized.

In addition, in the case where it is applied to a mold for plastic injection molding or a component thereof, the same effects as those of die casting can be obtained.

In the case where it is applied to a mold for warm forging, sub-hot forging or hot forging, overheating of a mold surface can be suppressed due to the high thermal conductivity. In addition, since high-temperature strength and toughness are also sufficient, wear and cracking can be reduced.

In the case where it is applied to hot stamping (also called hot pressing or press quenching) which is a molding method of a high-strength steel sheet, effects of high cycle due to high thermal conductivity and of suppressing wear and cracking of the mold can be obtained.

Furthermore, it is also effective to use the mold steel according to the present invention in combination with surface reforming (shot blasting, sand blasting, nitriding, PVD, CVD, plating, nitriding, etc.).

When the mold steel according to the present invention is formed into a bar or a wire, it can also be used as a welding repair material of a mold or a component thereof. Alternatively, it is also applicable to a mold or a component thereof which is manufactured by sheet or powder lamination molding. In this case, it is not necessary to manufacture the whole of the mold or the component thereof by lamination molding. A part of the mold or the component thereof may be manufactured by lamination molding. In addition, in the case where a complex internal cooling circuit is provided in a portion obtained by lamination molding, the effect of high thermal conductivity of the mold steel according to the present invention is more significantly exhibited.

The present invention has been described in detail with reference to the specific embodiments. However, it is obvious to those skilled in the art that various changes and modifications can be made within a range not departing the concept and scope of the present invention.

The present application is based on Japanese Patent Application (No. 2015-180193) filed on Sep. 11, 2015 and Japanese Patent Application (No. 2016-147774) filed on Jul. 27, 2016, the contents of which are incorporated herein by reference.

The invention claimed is:

1. A molding tool comprising following configurations:

(1) the molding tool contains a mold or a mold component alone or a combination thereof and includes a portion that comes into direct contact with a workpiece having a temperature higher than room temperature; and (2) at least one of the mold or the mold component is formed of a mold steel comprising:

$0.35<C<0.55$ mass %, $0.003\leq Si<0.300$ mass %, $0.30<Mn<1.50$ mass %, $3.10\leq Cr<3.50$ mass %, $0.003\leq Cu<1.200$ mass %, $0.003\leq Ni<1.380$ mass %, $1.46\leq Mo\leq 2.99$ mass %, $0.55<V<1.13$ mass %, and $0.0002\leq N<0.1200$ mass %, with a balance being Fe and unavoidable impurities, and satisfying $0.55<Cu+Ni+Mo\leq 3.16$ mass %, and has:

a hardness being higher than 33 HRC and 57 HRC or lower, a grain size number of prior austenite being 5 or more after being heated to 1,030° C., held 5 hours, and then cooled, a thermal conductivity λ at 25° C. measured by using a laser flash method being higher than 27.0 [W/m/K], and the hardness of lower than 280 HV after being heated to 820° C. to 900° C., control-cooled to 600° C. at 15° C./hr, allowed to stand to cool to 100° C. or lower, and then heated to 630° C.

2. The molding tool according to claim 1, wherein the mold steel further comprises:

$0.30<W\leq 5.00$ mass %, and/or $0.10<Co\leq 4.00$ mass %.

3. The molding tool according to claim 1, wherein the mold steel further comprises at least one element selected from the group consisting of:

$0.004<Nb\leq 0.100$ mass %, $0.004<Ta\leq 0.100$ mass %, $0.004<Ti\leq 0.100$ mass %, $0.004<Zr\leq 0.100$ mass %.

4. The molding tool according to claim 1, wherein the mold steel further comprises:

$0.10<Al\leq1.50$ mass %.

5. The molding tool according to claim 1, wherein the mold steel further comprises:

$0.0001<B\leq0.0050$ mass %.

6. The molding tool according to claim 1, wherein the mold steel further comprises at least one element selected from the group consisting of:

$0.003<S\leq0.050$ mass %,
$0.0005<C\leq0.2000$ mass %,
$0.03<Se\leq0.50$ mass %,
$0.005<Te\leq0.100$ mass %,
$0.01<Bi\leq0.50$ mass %, and
$0.03<Pb\leq0.50$ mass %.

7. The molding tool according to claim 1, wherein the mold component comprises a plunger tip, a sprue bush, a sprue core, an ejector pin, a chill vent, or an insert.

8. A mold steel, comprising:

$0.35<C<0.55$ mass %,
$0.003\leq Si<0.300$ mass %,
$0.30<Mn<1.50$ mass %,
$3.10\leq Cr<3.50$ mass %,
$0.003\leq Cu<1.200$ mass %,
$0.003\leq Ni<1.380$ mass %,
$1.46\leq Mo<\leq2.99$ mass %,
$0.55<V<1.13$ mass %, and
$0.0002\leq N<0.1200$ mass %, with a balance being Fe and unavoidable impurities, satisfying $0.55<Cu+Ni+Mo<\leq3.16$ mass %, having a grain size number of prior austenite of 5 or more after being heated to 1,030° C., held 5 hours, and then cooled, and having a hardness of lower than 280 HV after being heated to 820° C. to 900° C., control-cooled to 600° C. at 15° C./hr, allowed to stand to cool to 100° C. or lower and then heated to 630° C.

9. The mold steel according to claim 8, having:

the hardness being higher than 33 HRC and 57 HRC or lower, and a thermal conductivity $\lambda$ at 25° C. measured by using a laser flash method being higher than 27.0 [W/m/K].

10. The mold steel according to claim 8, further comprising:

$0.30<W\leq5.00$ mass %, and/or
$0.10<Co\leq4.00$ mass %.

11. The mold steel according to claim 8, further comprising at least one element selected from the group consisting of:

$0.004<Nb\leq0.100$ mass %,
$0.004<Ta\leq0.100$ mass %,
$0.004<Ti\leq0.100$ mass %,
$0.004<Zr\leq0.100$ mass %.

12. The mold steel according to claim 8, further comprising:

$0.10<Al\leq1.50$ mass %.

13. The mold steel according to claim 8, further comprising:

$0.001<B\leq0.0050$ mass %.

14. The mold steel according to claim 8, further comprising at least one element selected from the group consisting of:

$0.003<S\leq0.050$ mass %,
$0.0005<C\leq0.2000$ mass %,
$0.03<Se\leq0.50$ mass %,
$0.005<Te\leq0.100$ mass %,
$0.01<Bi\leq0.50$ mass %, and
$0.03<Pb\leq0.50$ mass %.

15. The molding tool according to claim 1, wherein $3.20\leq Cr<3.50$ mass %.

16. The molding tool according to claim 8, wherein $3.20\leq Cr<3.50$ mass %.

17. The molding tool according to claim 1, wherein $2.39\leq Mo\leq2.99$ mass %.

18. The molding tool according to claim 8, wherein $2.39\leq Mo\leq2.99$ mass %.

* * * * *